US006484628B2

(12) United States Patent
Otani et al.

(10) Patent No.: US 6,484,628 B2
(45) Date of Patent: Nov. 26, 2002

(54) WIRE PRINTING METHOD AND APPARATUS

(75) Inventors: Akihito Otani; Kenji Hashimoto, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/792,900

(22) Filed: Feb. 26, 2001

(65) Prior Publication Data

US 2001/0047730 A1 Dec. 6, 2001

(30) Foreign Application Priority Data

May 31, 2000 (JP) ..... 2000-161927

(51) Int. Cl.[7] ..... B41F 17/10
(52) U.S. Cl. ..... 101/35; 101/483; 101/44
(58) Field of Search ..... 101/35, 37, 38.1, 101/39, 40, 40.1, 483, 485, DIG. 30, DIG. 39, 41, 44

(56) References Cited

U.S. PATENT DOCUMENTS 4,370,542 A * 1/1983 Mills et al. ..... 101/35
5,353,699 A * 10/1994 Tamura ..... 101/35

FOREIGN PATENT DOCUMENTS

| | | |
|---|---|---|
| EP | 0 491 955 A1 | 12/1991 |
| EP | 0 508 695 A2 | 10/1992 |
| JP | 9-115364 | 5/1997 |
| JP | 11-27817 | 1/1999 |

* cited by examiner

*Primary Examiner*—Leslie J. Evanisko
(74) *Attorney, Agent, or Firm*—Anthony J. Casella; Gerald E. Hespos

(57) ABSTRACT

A printing apparatus is provided for precisely applying identifying indicia to wires connected with connectors without causing any displacement of position and orientation. The printing apparatus is provided with a palette 1 which is moved while being guided by slide rails 6, a wire receiving portion 2 on which wires 21 drawn from a connector 20 are placed, a wire correcting device 3, and a holder 4. The wire 21 fed to a marking section is pressed from above and is straightened in its longitudinal direction by the correcting device 3. The holder 4 holds the straightened wire 21 in the center of the marking section. In this state, printing is applied to the wire 21 by a laser marker 5.

10 Claims, 14 Drawing Sheets

WIRE PRINTING METHOD AND APPARATUS

BACKGROUND OF THE INVENTION

1. Field of the Invention

The invention relates to a method for printing or marking wires with identification indicia as part of a wire harness production process and while the wires are connected with connectors. The invention also relates to apparatus printing identification indicia on wires.

2. Description of the Related Art

Some electrical connectors have a plurality of terminal fittings mounted in a connector housing. Wires are connected to the terminal fittings and extend from the connector housing. The respective wires generally are of different colors to facilitate individual identification. This method of identifying wires increases the number of different types of wires required, and therefore decreases productivity and increases costs. As a result, some connectors employ several wires of the same color and print the wires with identifying characters and/or marks.

The identifying indicia typically are applied to the wires during a wire measuring operation. The marked wires then are cut and terminals are mounted to wire ends for insertion into a connector housing. However, the wire measuring operation must be stopped every time printing is applied to the wire. As a result, production efficiency and output are reduced. Furthermore, the terminal is mounted on the wire and inserted into the connector housing after printing. Consequently, the position and direction of printing on the wire drawn from the connector may be displaced. The position and orientation of the printing may be specified beforehand. However, such displacements need to be checked and corrected during the assembly process, and hence production efficiency is reduced further.

An object of the present invention is to solve the above problems and to improve the productivity of a wiring harness.

SUMMARY OF THE INVENTION

The invention is directed to a wire printing method, comprising a step of providing at least one wire that is connected with a connector and then feeding the wire to a marking section together with the connector. The feeding step preferably is carried out with the connector and/or the wire at least partly supported by a palette or holder for conveyance. The method then comprises pulling the wire that extends from the connector substantially straight in the marking section and holding the substantially straightened wire in the marking section. The method further comprises applying identifying indicia to the wire in this state by a printing device provided in or near the marking section.

According to a preferred embodiment, the step of applying identifying indicia comprises applying printing to an insulation coating of the wire by a non-contact printing device provided in the marking section.

The printing is applied to the wires after the wires have been connected with the connector. Thus the printing can be done without stopping a wire measuring operation, thereby eliminating a loss of time.

The invention also is directed to a wire printing apparatus that comprises a palette or holder for holding a connector such that the connector can be fed at an angle to the direction that the wire extends from the connector. The angle of feed preferably is substantially a right angle. The apparatus also comprises a wire receiving portion or table on which portions of wires that extend from the connector can be placed. A wire-correcting device is provided, including an elevating or moving mechanism and an advancing mechanism. The apparatus further comprises a holder including an elevating or moving mechanism and a printing or marking device. The printing or marking device is provided substantially above or near a marking section of the apparatus. The wire correcting device can be moved to press the wire fed to the marking section and can be advanced away from the connector for at least partly straightening the wire on the wire receiving portion in the wire drawing direction from the connector. The holder can be moved to hold the substantially straightened wire in the marking section, and printing can be applied to the wire by the printing device in this state. According to a preferred embodiment, the printing device is a non-contact printer.

The wire connected with the connector may be buckled or bent. In this situation, printing cannot be applied directly to the wire because the buckled or bent wire cannot be positioned precisely. Thus, according to the present invention, the wire that extends from the connector is pulled sufficiently to be straightened by the wire-correcting device, and printing is applied while the holder holds the straightened wire in the center of the marking section. With such an arrangement, no omission of printing occurs due to the displacement of the wire. Additionally, the position and orientation of printing can be maintained constantly. Thus, it is not necessary to correct the displacement even when the position and orientation of printing are specified.

Preferably, a plurality of wires extend from a single connector and are fed successively to the marking section by moving the palette in a direction at an angle to the wire, and preferably substantially normal to the wires that extend from the connector.

This apparatus may additionally comprise a moving mechanism for moving the palette that holds the connector in the direction normal to the wires. The moving mechanism may function after the wires that extend from the connector are fed successively to the marking section. Accordingly, printing can be applied continuously.

The wire-correcting device preferably comprises a roller that can be rotated in a wire straightening direction. The roller may be formed with a substantially V-shaped groove, and the roller may be rotated in a wire straightening direction. Thus, the wire can be straightened while being centered by the surface of the groove of the roller.

Alternatively, the wire-correcting device may comprise a roller that has no groove. The roller is rotated in a wire straightening direction and the wire is pushed and centered into a substantially V-shaped groove formed in the wire-receiving portion by the roller to be.

The wire-correcting device may comprise two eccentrically arranged rollers mounted on a holding member having a pivotal center displaced from the centers of rotation of the two rollers. Thus the two wires can be pulled simultaneously to enable simultaneous application of printing to the wires. Additionally, the two wires may have different diameters.

The wire-correcting device preferably comprises a roller, which causes no fretting to prevent the wires from being scratched or otherwise damaged. For example, the wire-correcting device may be provided with a soft pad and may have substantially V-shaped grooves for centering. The wires can also be straightened by a method for pressing the wires by the soft pad while lightly bringing the surfaces of the substantially V-shaped grooves into contact with the wires.

The holder may comprise a chuck for gripping the substantially straightened wire from opposite sides. A brush may be operable with the wire-correcting device to brush gripping surfaces of the chuck by passing the brush between the gripping surfaces during advancing and retracting movements of the wire-correcting device. The brush preferably is used when a laser marker is used as the printing device.

A sensor may be provided for detecting whether the wire is positioned in the marking section. The printing device then applies printing to the wire in accordance with a detection signal from the sensor. Thus, a laser beam is not emitted if no wire is present, and damage to the table by the laser can be avoided.

The holder may comprise at least one pressing element for pressing and holding the substantially straightened wires. The pressing element is formed with a through hole in or through which printing can be applied, and the straightened wire can be pressed and held from above by the holder. This construction is particularly effective when printing is applied simultaneously to a plurality of wires. More particularly, this construction enables the respective wires to be held at simultaneously by one holder unlike the chuck, and is not subject to restriction on installation space.

A laser beam of a laser marker is likely to produce cinders of the insulation coating, and the cinders are likely to adhere to the gripping surfaces of the chuck. However, the brush removes adhered cinders and other such debris from the gripping surfaces before the chuck grips a next wire. Therefore, adhered matter on the gripping surfaces is not transferred to the wire and does not smear the applied identification markings.

These and other objects, features and advantages of the present invention will become apparent upon reading of the following detailed description of preferred embodiments and accompanying drawings. It should be understood that even though embodiments may be described separately, single features of the respective embodiments may be combined to additional embodiments.

DETAILED DESCRIPTION OF THE PREFERRED EMBODIMENTS

Figure 1:
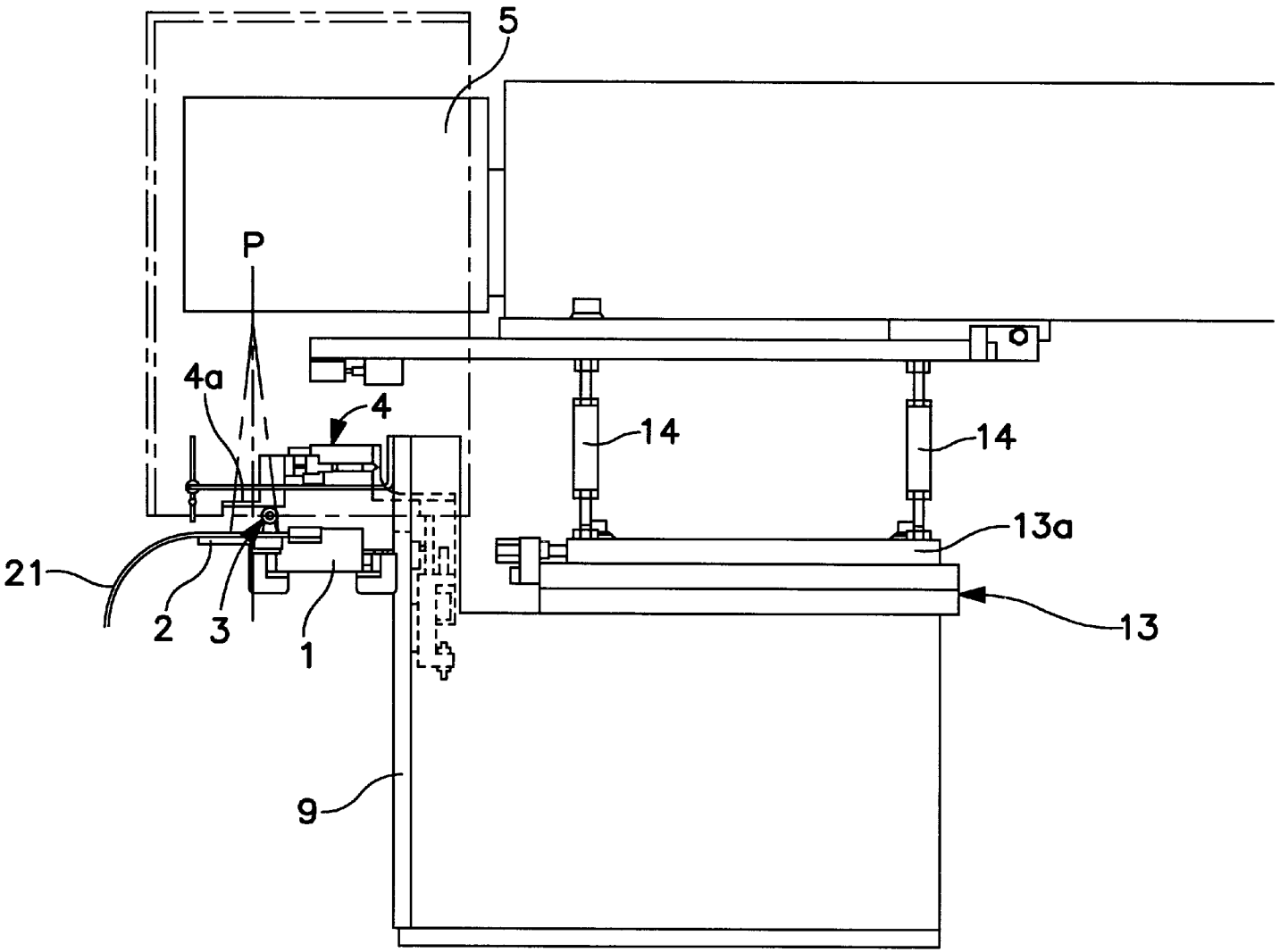
FIG. 1 is a side view showing a printing apparatus according to one embodiment of the invention.
Figure 2:
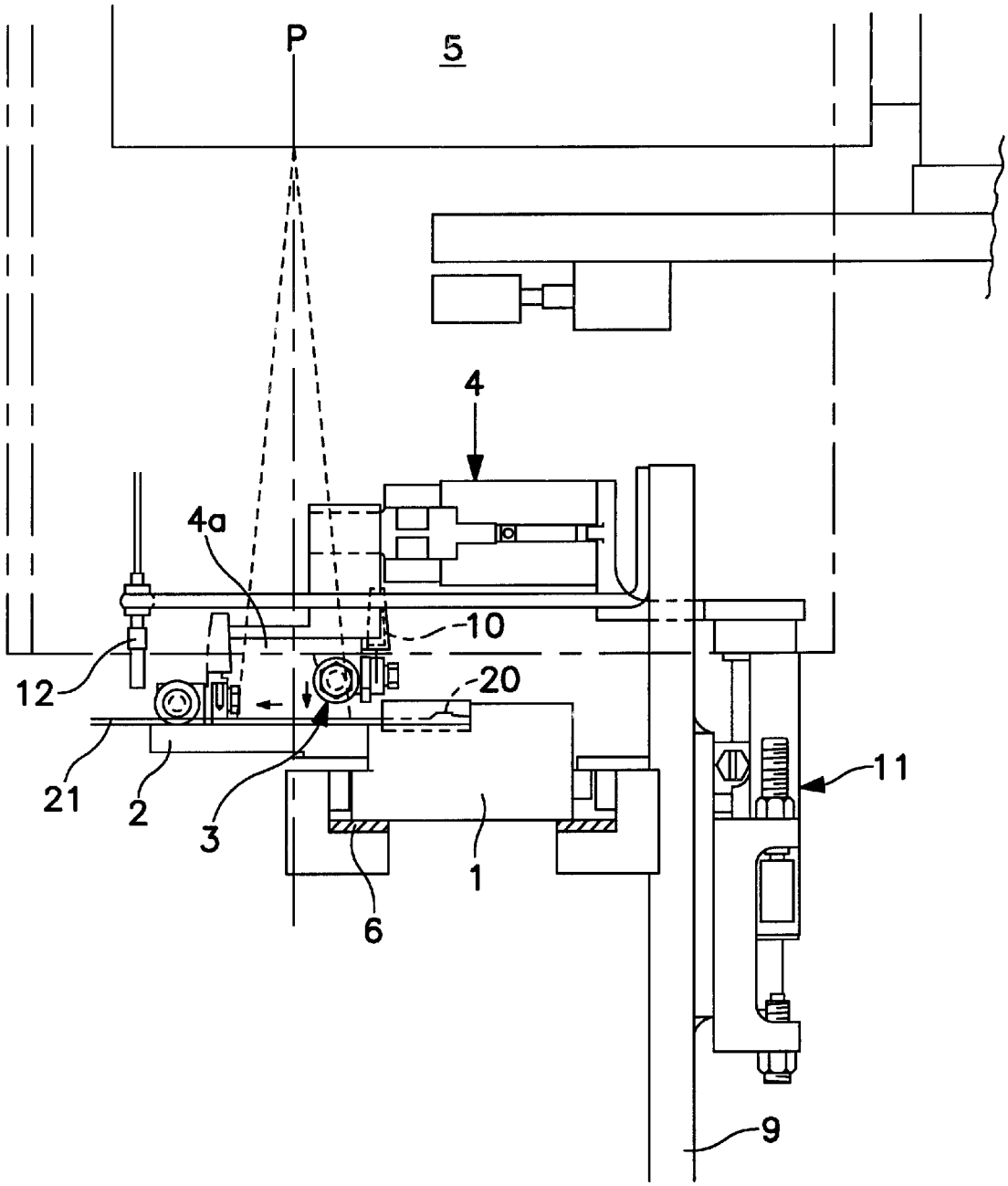
FIG. 2 is an enlarged side view showing an essential portion of the printing apparatus.

A printing apparatus in accordance with the invention is provided with a palette or holder 1 shown in FIGS. 1 and 2 for holding and conveying a connector. The printing apparatus also includes a feeding mechanism (not shown) for laterally moving the palette 1, or moving the palette 1 in a direction at an angle different from 0° or 180°, and preferably substantially normal to a conveying direction. A wire-receiving portion or table 2 is provided and ends of wires connected with a connector 20 are placed on the wire-receiving portion 2 the printing apparatus further includes a wire-correcting device 3 and a holder or chuck 4, provided above or on the wire receiving portion 2. Finally, a laser marker 5 is provided above or near a marking section of the wire receiving portion 2.

The palette 1 is conveyed along slide rails 6 from a previous station to a printing station, shown in FIG. 2. In at least one previous operation step, the wires are measured, cut and connected with the connector. The connecting operation may comprise: stripping an insulation coating at an end of a wire to expose a conductor; mounting a crimping terminal to the exposed conductor; and inserting the crimping terminal into a connector set in the palette 1. Alternatively, the connecting operation may comprise: inserting an insulation-displacement terminal into a connector; pressing an end of a wire into the insulation-displacement terminal to electrically connect contact pieces of the terminal and a conductor by cutting an insulation coating of the wire by the contact pieces; and then crimping barrels of the terminal to hold the insulation coating of the wire.

Figure 7:
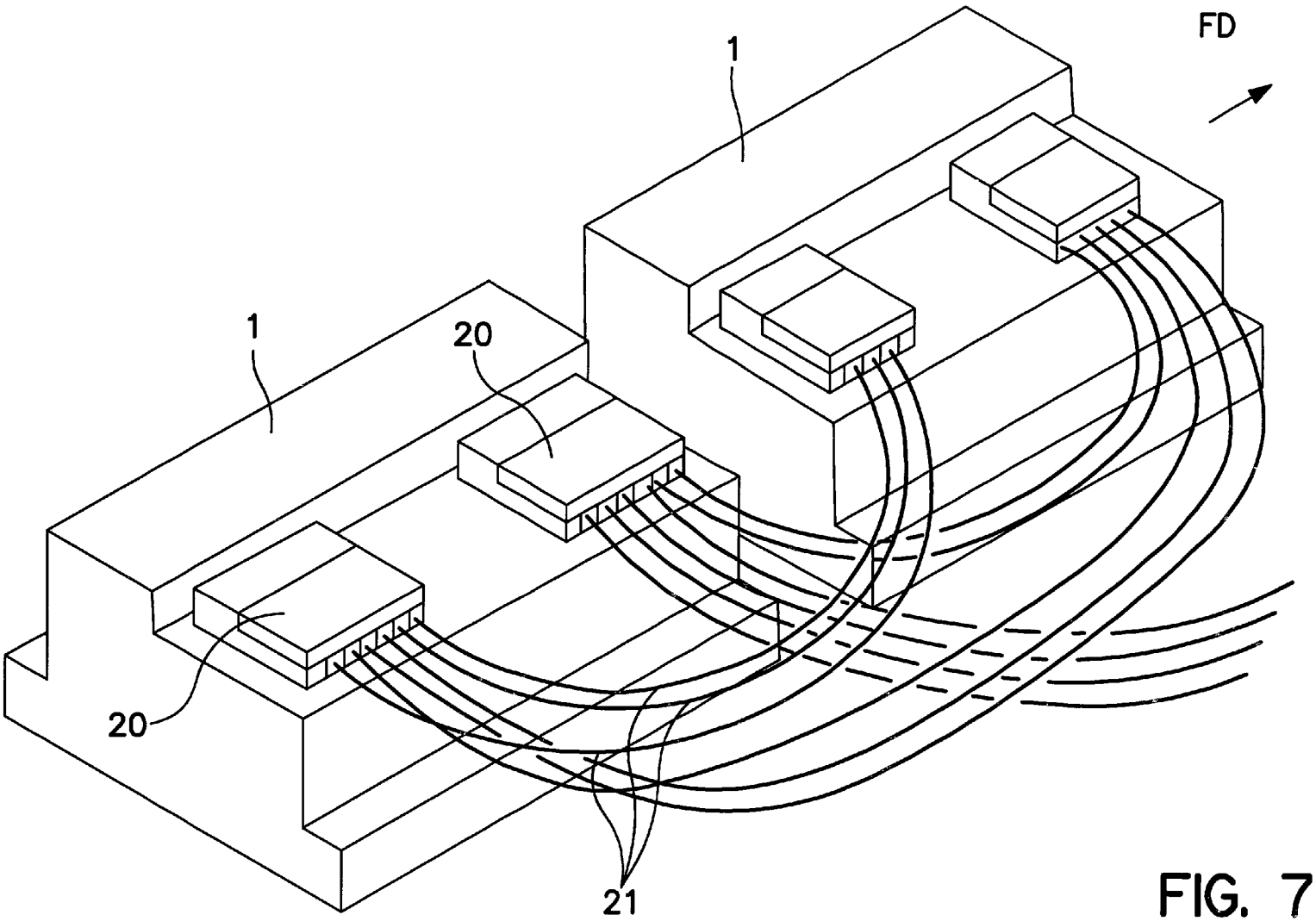
FIG. 7 is a plan view showing a simplified example of wires connected with connectors.

FIG. 7 shows an example of a final wiring harness obtained by connecting wires 21 with connectors 20. The palettes 1 are moved to the printing station while carrying a product in this mode or way.

The feeding mechanism for moving the palettes 1 in a feeding direction indicated by the arrow FD of FIG. 7 may be a known mechanism, such as rotating a ball screw driven by a servo motor to move a slider that is engaged with the ball screw. The slider of this feeding mechanism is coupled to the palette 1 via a detachable coupling device to move the palette 1. The palette 1 can be detached from the slider of the feeding mechanism after printing or marking and detachment of the connector from the palette 1 and can be returned to a starting end of a processing line via a return path (not shown).

The wire-receiving portion or table 2 is provided along a movement path (forward path) of the palette 1, and the correcting device 3 on the wire-receiving portion 2 corrects the wires 21.

Figure 5:
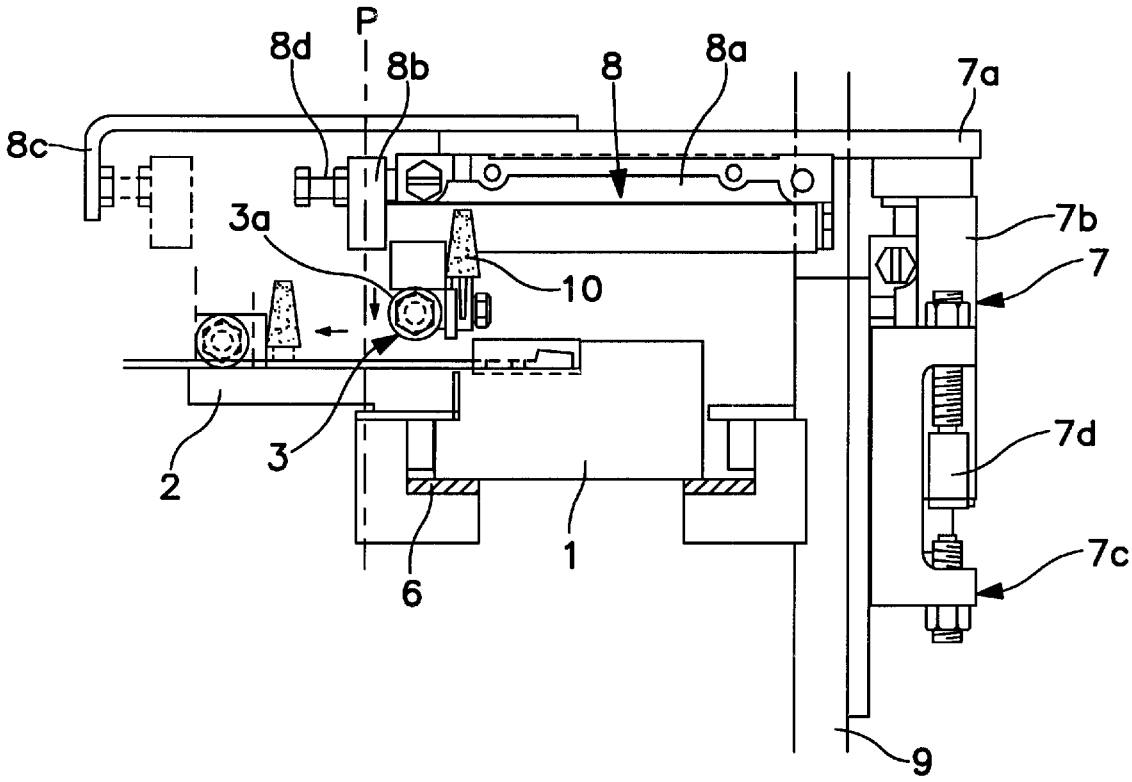
FIG. 5 is a detailed diagram of a portion along V—V of FIG. 3.

The correcting device 3 includes an elevating mechanism 7 and an advancing mechanism 8, as shown in FIG. 5. The elevating mechanism 7 moves a movable frame 7*a* upward and downward or toward and away from the movement path in a direction at an angle different from 0° or 180° thereto by means of an air cylinder 7*b*. An adjusting device 7*c* is provided for adjusting ranges of upward and downward movements of the movable frame 7*a*. A stopper 7*d* is mounted on the movable frame 7*a* and contacts an adjustment bolt of the adjusting device 7*c* when the movable frame 7*a* reaches top and bottom end positions. The air cylinder 7*b* and the adjusting device 7*c* are mounted on a fixed frame 9.

The advancing mechanism 8 includes an air cylinder 8*a* mounted on the movable frame 7*a*. A movable arm 8*b* is pushed and pulled by the cylinder 8*a*.A stopper 8*c* is provided for stopping the movable arm 8*b* at an advance end position, and an adjusting device 8*d* is provided for adjusting a stop position or a movable range. The adjusting device 8*d* may be provided on the stopper 8*c*.

Figure 6:
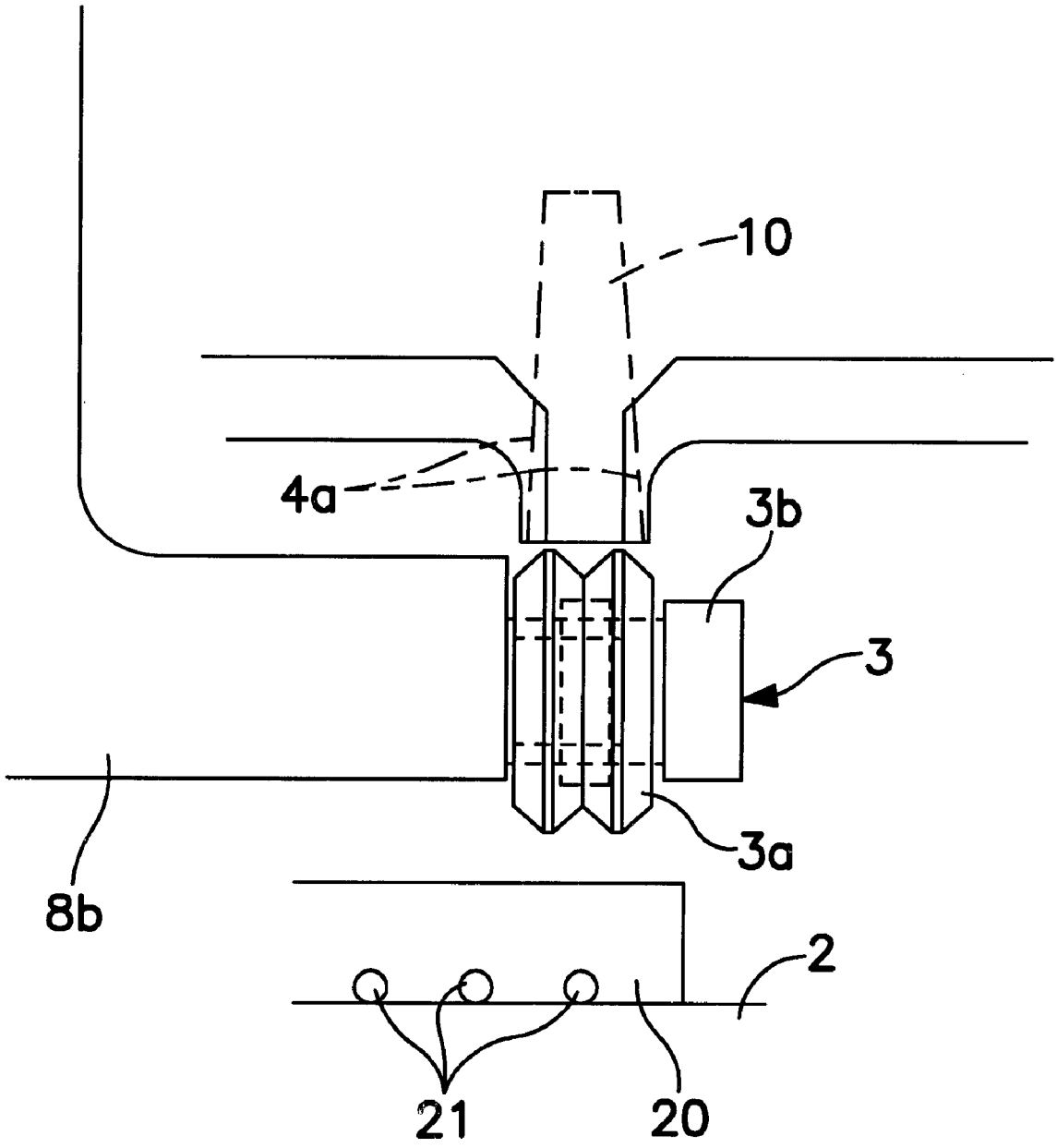
FIG. 6 is an enlarged front view of a correcting device.

The correcting device 3 includes a roller 3*a* formed with a groove that preferably is substantially V-shaped, as shown in FIG. 6. The correcting device further includes a shaft 3*b* that is mounted on the movable arm 8*b* and that preferably is substantially horizontally aligned. The roller 3*a* is supported on the horizontal shaft 3*b* for rotation. The V-shape of the groove of the roller 3*a* corrects the position and orientation of the wire and centers the wire. Hence the roller 3*a* can accommodate wires of different sizes. A brush 10 is mounted vertically on the movable arm 8*b* and is tapered toward its leading end.

The holder or chuck 4 preferably is an air chuck for gripping the wire 21 from opposite sides by opening and closing a pair of transversely arranged parallel hands or grippers 4*a*. The chuck 4 includes an elevating mechanism 11 shown in FIG. 2. The elevating mechanism 11 has the same or similar construction as the elevating mechanism 7 of the correcting device 3.

Figure 3:
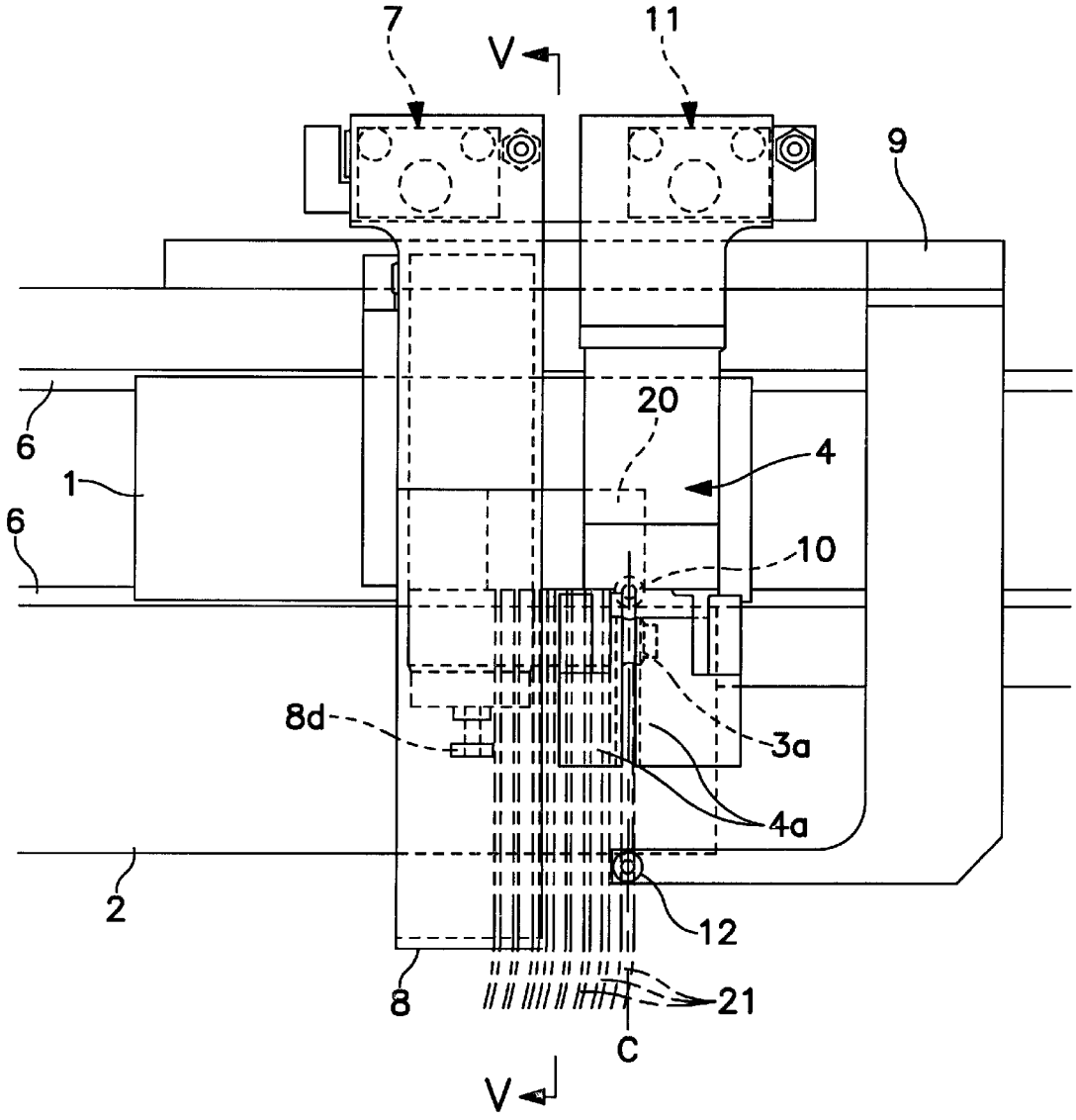
FIG. 3 is an enlarged plan view showing the essential portion of the printing apparatus.

An optical fiber sensor 12 is supported on the fixed frame 9, as shown in FIGS. 2 and 3, for detecting a wire. The sensor 12, the roller 3*a,* the brush 10 and the substantially parallel hands 4*a* of the chuck 4 are arranged on a centerline C (see FIG. 3) of the marking section.

The laser marker 5 is provided on the fixed frame 9 via a position adjusting mechanism 13 as shown in FIG. 1. The position adjusting mechanism 13 moves or allows a change of the position of a supporting plate 13*a* to front, back, left and right within a range of e.g. about 10 mm to precisely position an emission center P of a laser beam shown in FIGS. 1, 2 and 5.

Figure 4:
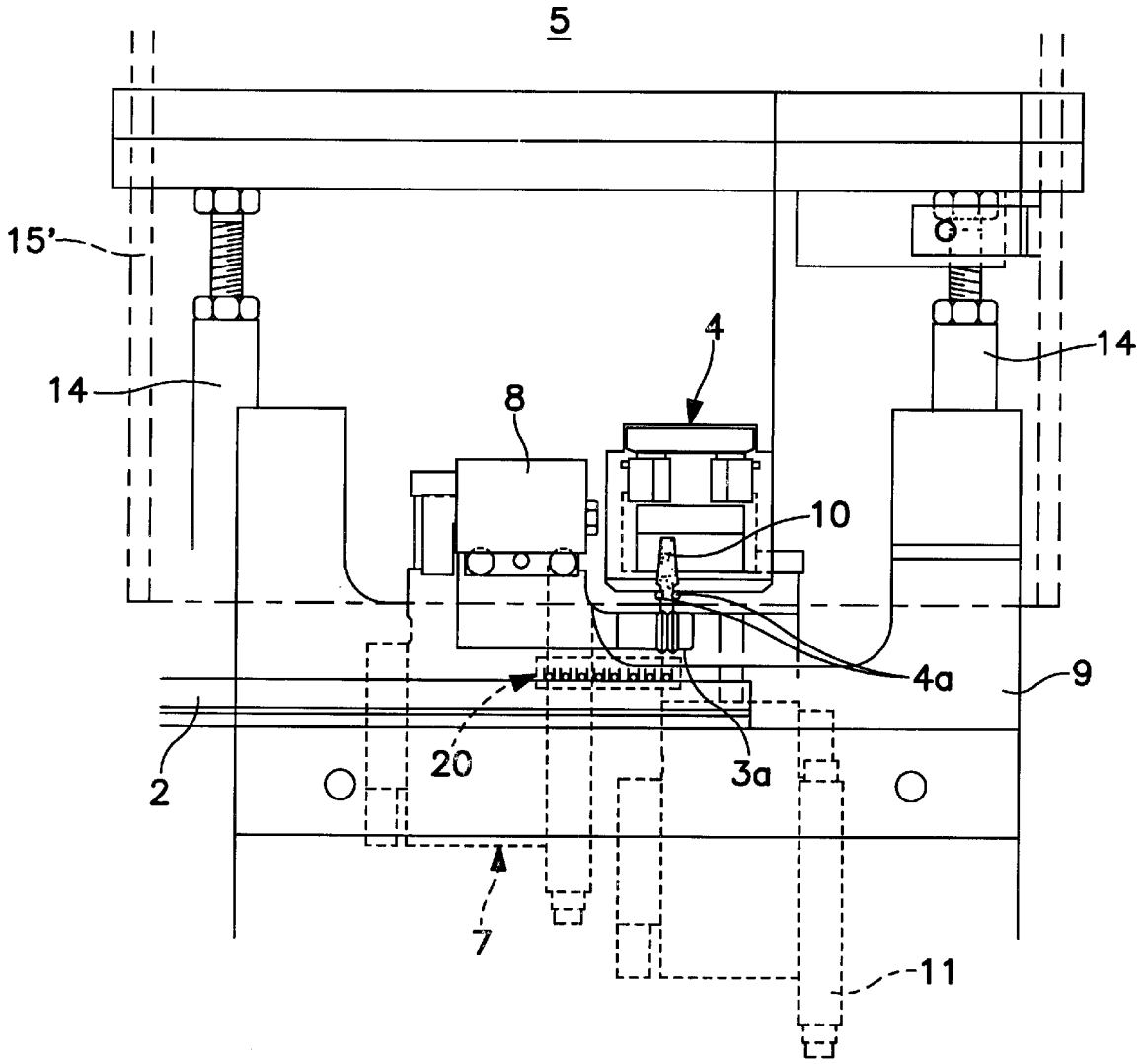
FIG. 4 is an enlarged front view showing the essential portion of the printing apparatus.

A turnbuckle adjustment means 14, 15' is provided, as shown in FIGS. 1 and 4, for adjusting the height position of the laser marker 5 and a safety cover, respectively.

Figure 8:
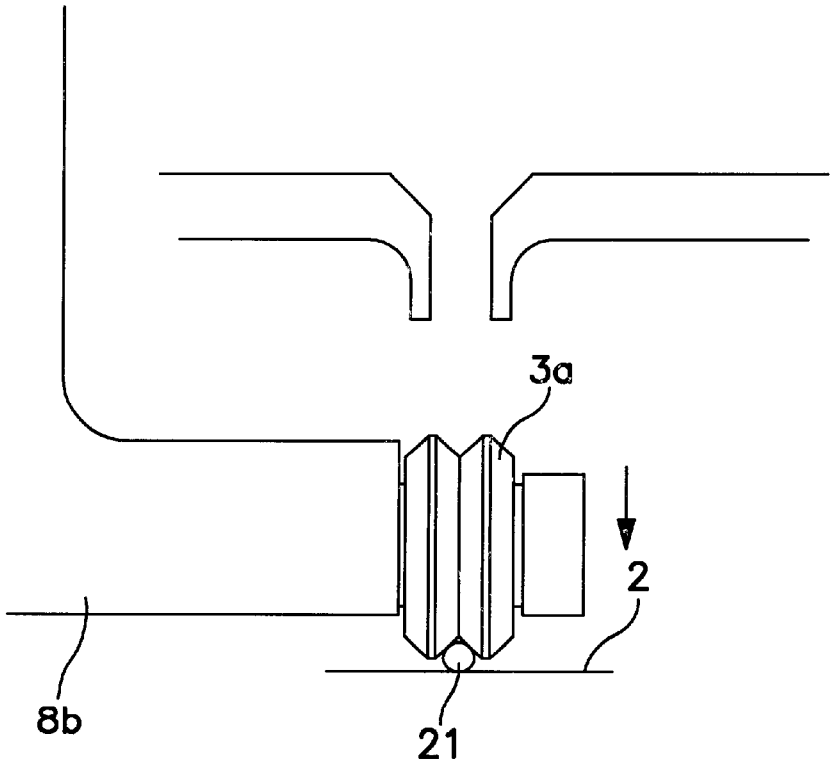
FIG. 8 is a front view showing a wire correcting operation by the correcting device.
Figure 9:
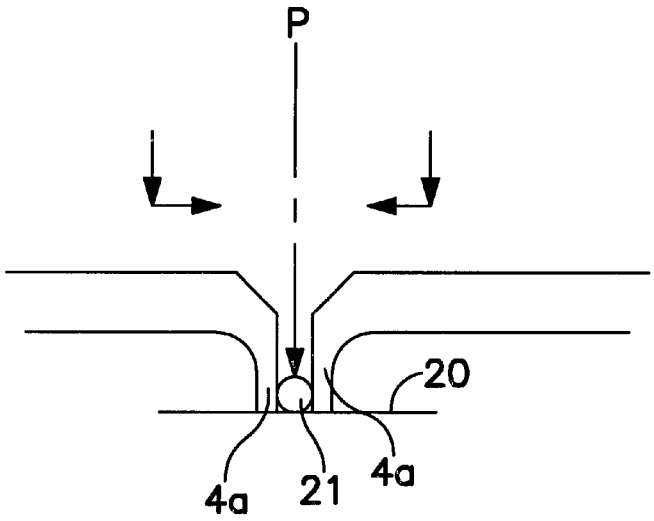
FIG. 9 is a front view showing a state of a corrected wire held by a chuck.
Figure 10:
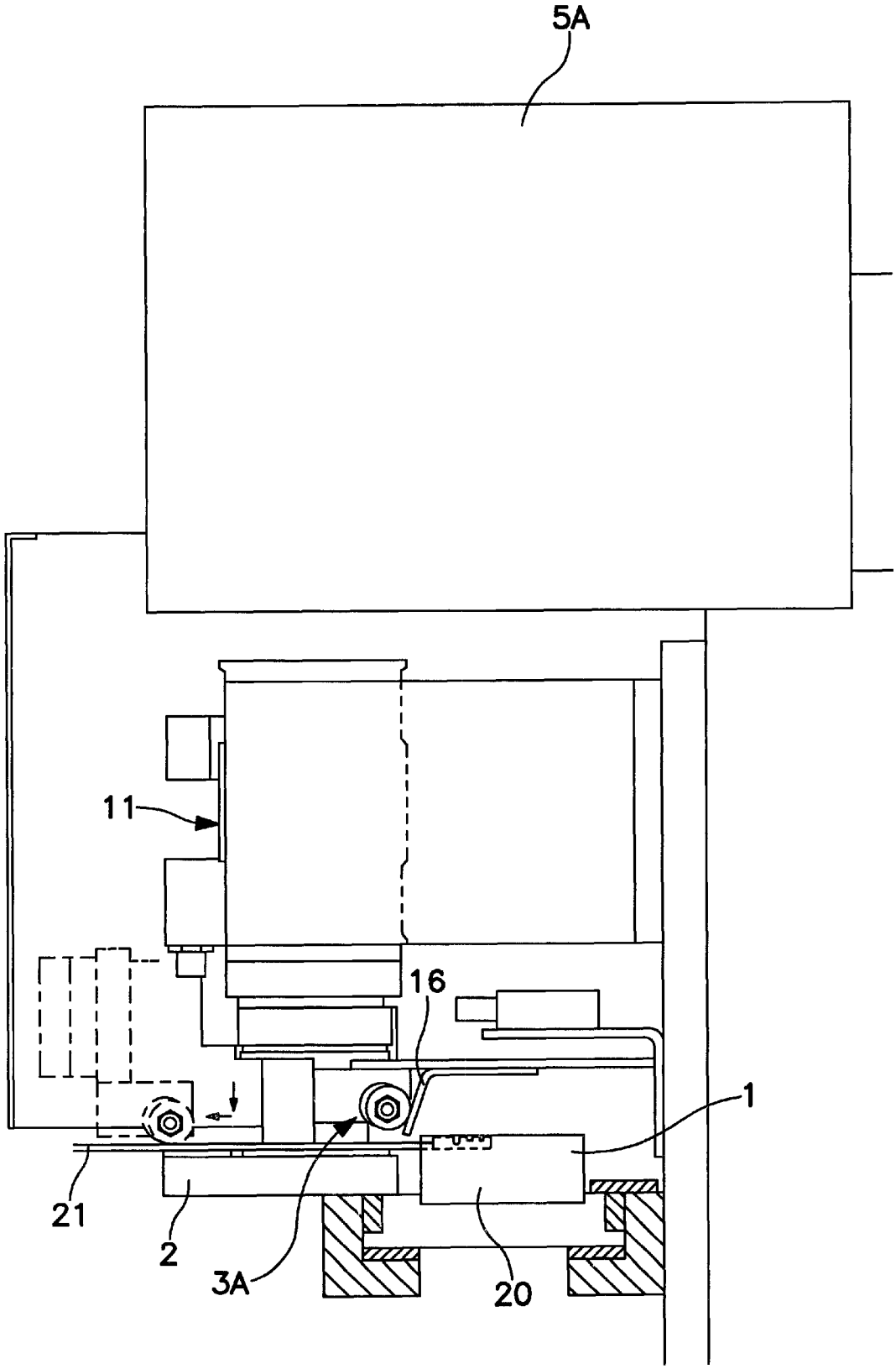
FIG. 10 is a side view of a printing apparatus according to another embodiment.
Figure 11:
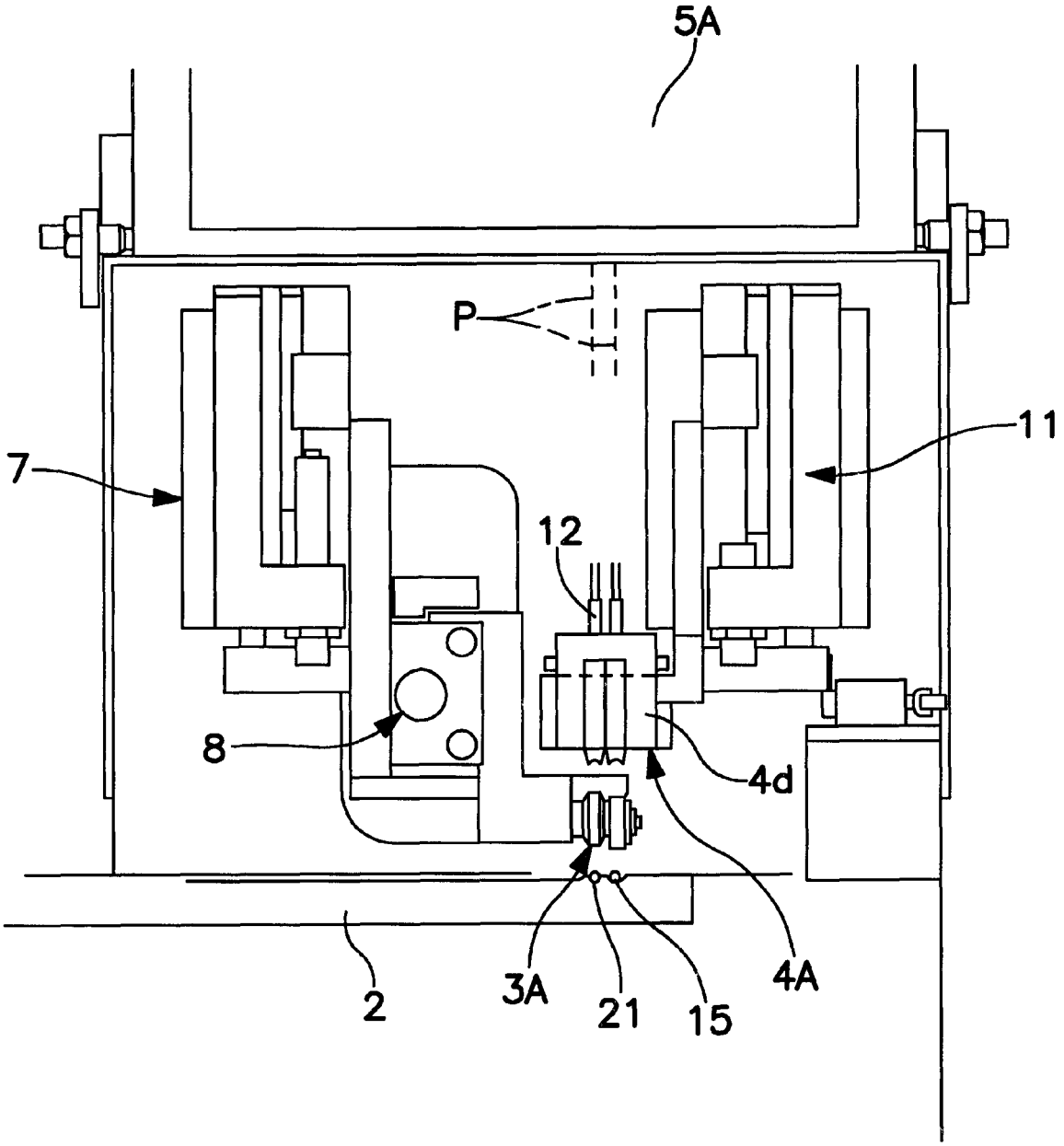
FIG. 11 is a front view of the apparatus of FIG. 10.
Figure 12:
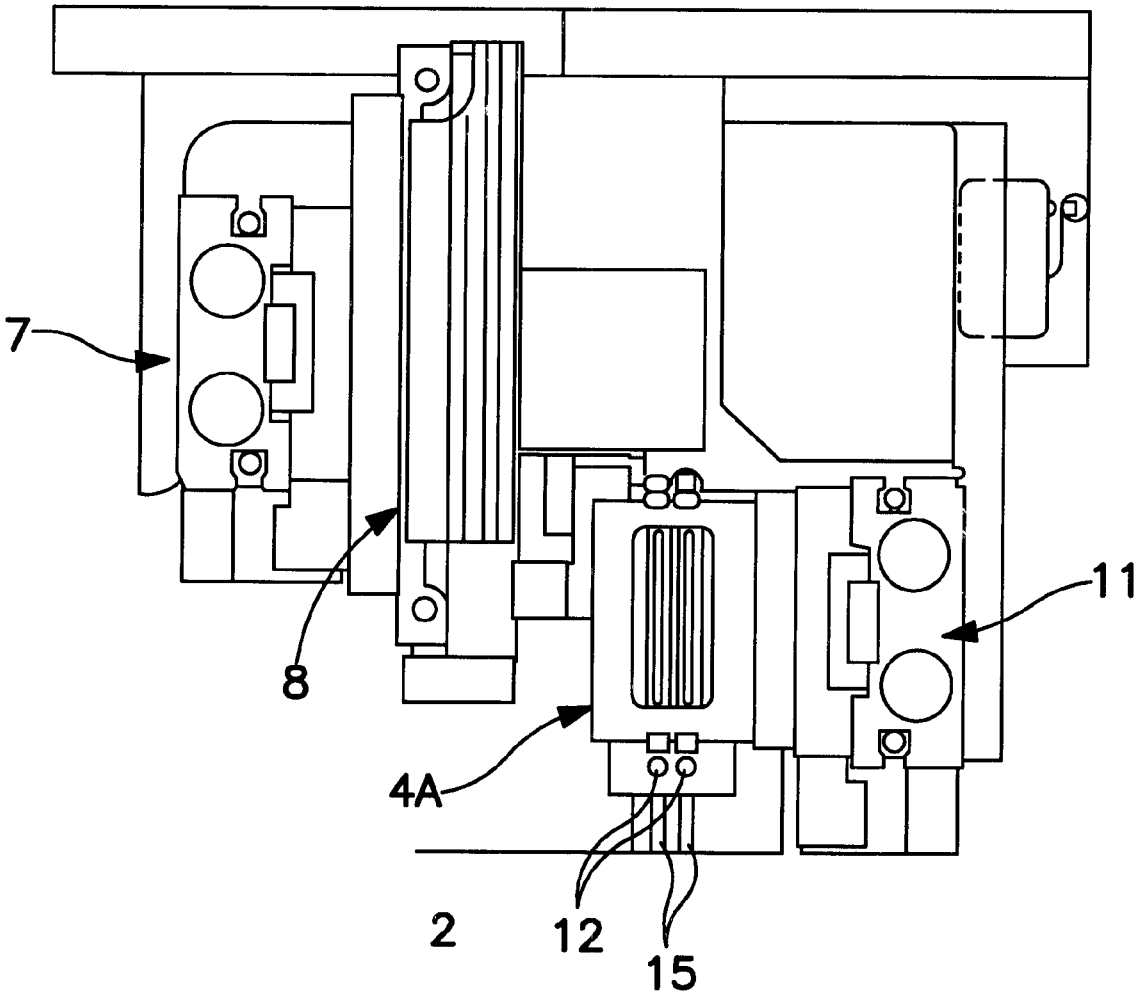
FIG. 12 is a plan view showing an essential portion of the apparatus of FIG. 10.
Figure 13B:
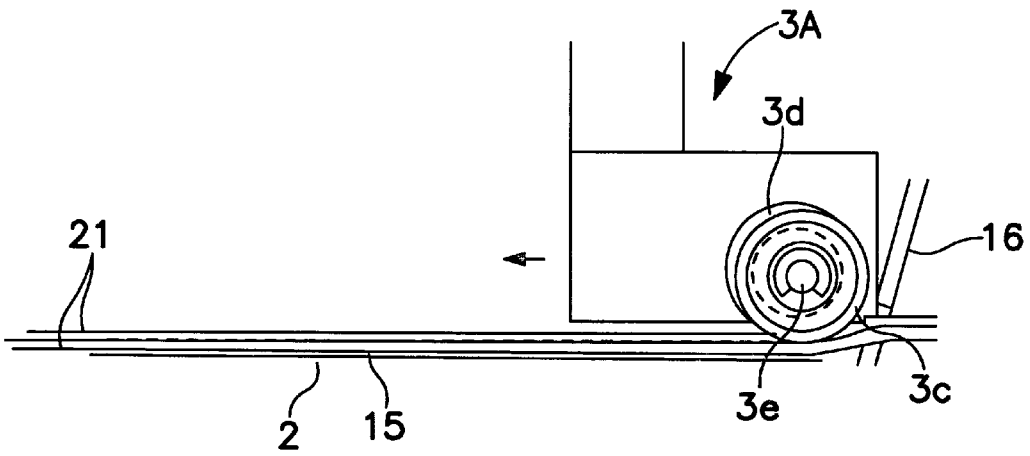
FIG. 13(*a*) is a plan view of a wire correcting device using a pair of rollers, FIG. 13(*b*) is a side view of the wire correcting device of FIG. 13(*a*), FIG. 13(*c*) is a front view of the wire correcting device of FIG. 13(*a*), and FIG. 13(*d*) is a perspective view of a holding shaft.
Figure 13D:
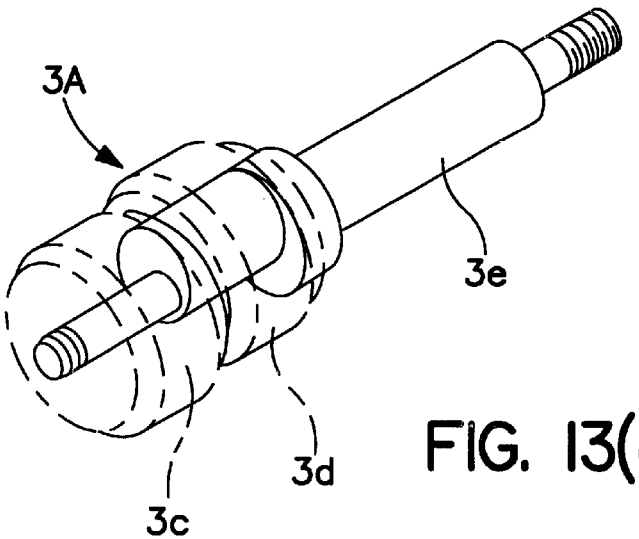
Figure 13A:
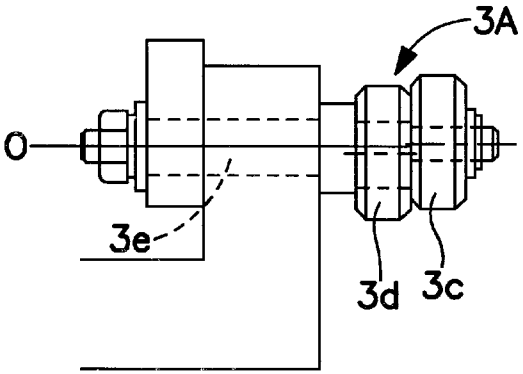
Figure 13C:
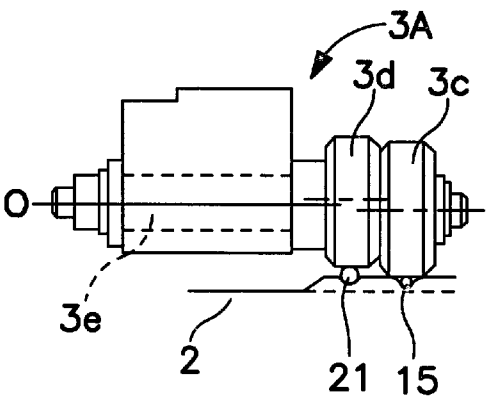

The printing apparatus is operated by moving the palette 1 to or near the printing station and then stopping the movement. The correcting device 3 then is lowered to press the wire 21 drawn from the connector 20 substantially from above, as shown in FIG. 8. The correcting device 3 then rotates or moves away from the connector 20 to straighten the wire 21. The chuck 4 is lowered when the correcting device 3 is advanced to and stopped at a position shown in phantom line in FIG. 2, and the parallel hands 4*a* are closed to grip the wire 21 from opposite sides, as shown in FIG. 9. At this time, the wire 21 is positioned precisely on the centerline C of the marking section and printing is made on the wire 21 by the laser marker 5 in this state. Accordingly, there is no problem of printing omission and displacement.

Upon completion of printing or marking, the parallel hands 4a are opened to return the chuck 4 and then the correcting device 3 is retracted. Gripping surfaces of the parallel hands 4*a* are cleaned by the brush 10 during the retracting and advancing movements of the correcting device 3 to remove cinders of the insulation coating adhered to the gripping surfaces. The correcting device 3 is returned to an initial position by moving upward and then moving backward. After printing on the first wire is completed, the feeding mechanism moves the palette 1 by a specified distance to set the second wire in the marking section. The above operation is repeated for the second and subsequent wires. In this way, all wires are printed for identification.

FIGS. 10 to 14 show a printing apparatus according to a second embodiment. This apparatus differs from the apparatus of FIGS. 1 to 6 in that substantially V-shaped grooves for centering wires are formed in the wire-receiving portion 2. A wire correcting device 3A is provided for simultaneously pressing two wires 21. Additionally, a holder 4A is provided for holding the wires 21 by pressing them from above, and a pressing device 16 is provided for pushing down ends of the wires 21 that extend from a connector. The elevating mechanisms 7, 11 and the advancing mechanism 8 have the same or similar functions as those described above, although they have different configurations.

The wire correcting device 3A is constructed, as shown in FIG. 13(*a*), by mounting two eccentrically arranged rollers 3*c,* 3*d* on a holding shaft 3*e* having its center of rotation O in a position displaced from the centers of rotation of the two rollers 3*c,* 3*d*. The wire correcting device 3A operates such that, when there is a difference in the diameters of two wires 21 to be pressed by the rollers 3*c,* 3*d,* the holding shaft 3*e* is rotated to automatically adjust the heights of pressing points by the rollers 3*c*, 3*d* in conformity with the diameters of the wires 21. Accordingly, the wire correcting device 3A can securely straighten the two wires 21 by pressing them even if the diameters of the wires 21 differ. Although the rollers 3*c,* 3*d* shown in FIGS. 13(*a*) to 13(*d*) are not formed with a groove, rollers formed with a groove may be used. In such a case, the substantially V-shaped grooves 15 formed in the wire-receiving portion 2 may be omitted.

Figure 14B:
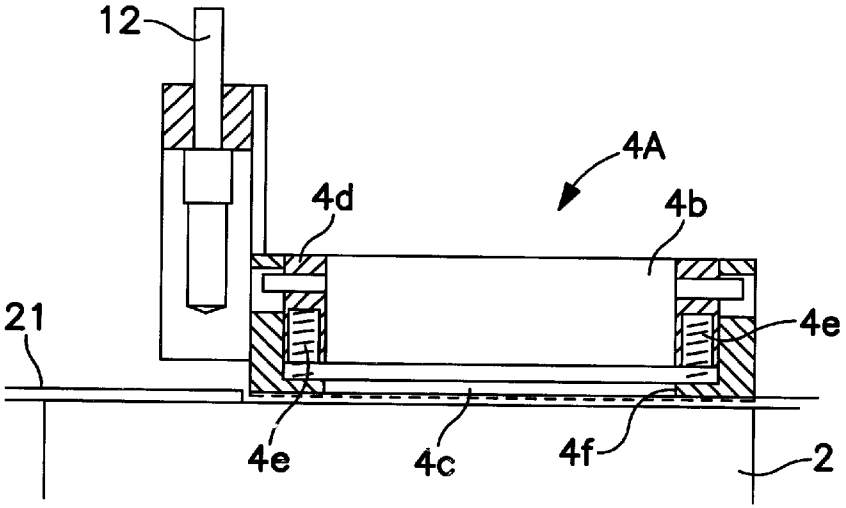
FIG. 14(*a*) is a plan view of a holed holder, FIG. 14(*b*) is a vertical sectional side view of the holed holder, and FIG. 14(*c*) is an enlarged view of the holed holder.
Figure 14C:
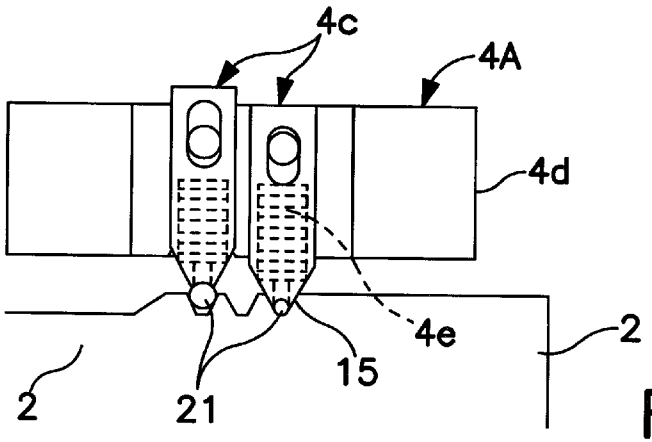
Figure 14A:
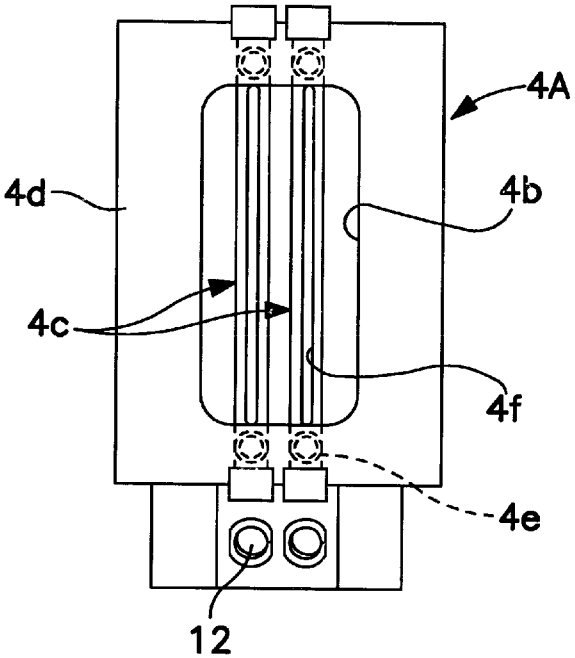

A hole 4*b* extends vertically through the holder 4A, as shown in FIG. 14(*a*), and pressing elements 4*c* extend through the hole 4*b*. The pressing elements 4*c* have substantially V-shaped grooves in their bottom surfaces for holding and positioning the corrected wires 21. The pressing elements 4*c* are mounted on a holed frame 4*d* of the holder 4A and can be moved upward and downward by the elevating mechanism 11 towards and away from the wire-receiving portion 2. However, the pressing elements 4*c* are biased downward by springs 4*e*. When a thick wire is pressed, the pressing elements 4*c* compress the springs 4*e* to escape upward. The pressing elements 4*c* each are formed with a slit 4*f* for exposing a printing surface of the wire 21 to the outside via the hole 4*b,* and the two wires 21 are printed or marked simultaneously by laser markers 5A (see FIG. 10) in the slits 4*f*.

Figure 15A:
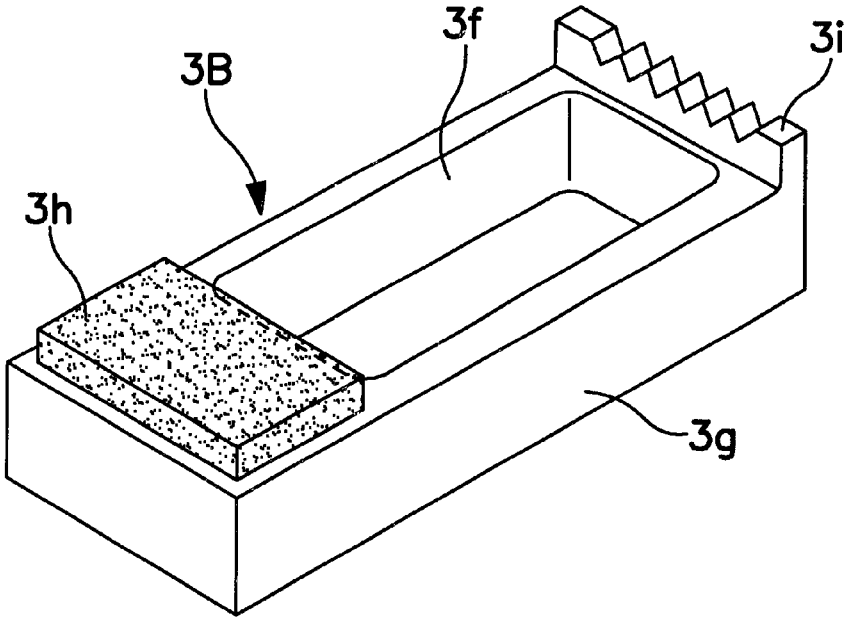
FIG. 15(*a*) is a perspective view showing another example of the wire correcting device turned upside down, and FIG. 15(*b*) is a side view of the wire correcting device of FIG. 15(*a*).
Figure 15B:
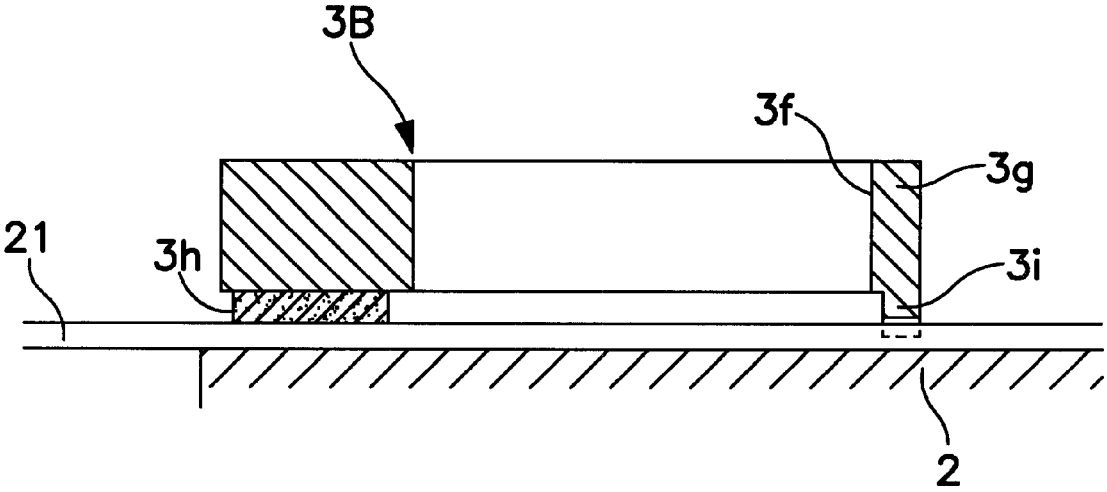

FIG. 15 shows a wire correcting device 3B having no roller. The wire correcting device 3B has a sponge pad 3*h* and a centering claw 3*i* formed on the bottom surface of a main body 3*g* and is moved by an elevating mechanism and an advancing mechanism (both not shown). The main body 3*g* is formed with an opening 3*f* through which a laser beam is projected, and the wires 21 on the wire receiving portion 2 are pressed by the sponge pad 3*h* while being centered by substantially V-shaped grooves formed in the centering claw 3*i*. Such a correcting device can also pull and align the wires in the centers of marking points.

Characters printed on the wires are preferably difficult to erase. In this respect, a printing device used is preferably a laser marker shown in the drawings. However, if it is not particularly specified, a printing device of the ink-jet type may also be used.

As described above, according to the inventive printing method and printing apparatus, the wires connected with the connector are fixed by the connector set in the wire holder. Buckled or bent wires are straightened using the wire correcting device in this state, and printing is applied while the straightened wires are positioned and held by the chuck. Thus, it is not necessary to stop the wire measuring operation every time printing is applied, and productivity can be improved by eliminating a loss of time.

Since the position and orientation of printing are constant, it is not necessary to correct them and productivity can be improved further.

The wires are neither smeared nor scratched in the apparatus having the wire-correcting device realized by the roller formed with a V-shaped groove or provided with the brush for cleaning the gripping surface.

If the two rollers are provided to adjust the heights of their pressing points automatically, two wires can be printed simultaneously regardless of whether they have the same diameter or different diameters, which leads to an improved productivity.

Further, the apparatus provided with the wire-detecting sensor can be protected better because a laser beam for printing is not projected onto the wire receiving portion.

What is claimed is:

1. A wire printing method, comprising the steps of:

feeding at least one wire connected with a connector to a marking section together with the connector, such that the wire is supported at least partly by a palette for conveyance, pulling the wire drawn from the connector substantially straight in the marking section and holding the wire in the marking section, and applying identifying indicia to the wire in this state by a printing device provided in proximity to the marking section.

2. A wire printing apparatus, comprising:

a palette for holding a connector such that the connector can be fed in a direction substantially transverse to a direction of extension of at least one wire from the connector, a wire-receiving portion for receiving a portion of the at least one wire extending from the connector on the palette, a wire-correcting device in proximity to the wire receiving portion, the wire correcting device including an elevating mechanism moveable toward the wire receiving portion to press the wire in the wire receiving portion and an advancing mechanism moveable away from the palette for straightening the pressed wire, a holder in proximity to the wire receiving portion, the holder including a moving mechanism for holding the straightened wire, and a printing device in proximity to the holder for printing identifying indicia on the straightened wire held by the holder.

3. The wire printing apparatus of claim 2, wherein the printing device is a non-contact printer.

4. The wire printing apparatus of claim 2, wherein a plurality of wires extend from the connector, and wherein the wires are fed successively to the wire receiving portion by moving the palette in the direction.

5. The wire printing apparatus of claim 2, wherein the wire correcting device comprises at least one roller formed with a substantially V-shaped groove, the roller being rotated in a wire straightening direction, such that the wire can be straightened and centered by the groove of the roller.

6. The wire printing apparatus of claim 2, wherein the wire correcting device comprises at least one roller having no groove, the roller being rotated in a wire straightening direction, a substantially V-shaped groove being formed in the wire receiving portion, such that the roller pushes the wire into the groove of the wire receiving portion for substantially centering the wire.

7. The wire printing apparatus of claim 6, wherein the wire correcting device comprises two eccentrically arranged rollers mounted on a holding member having a pivotal center displaced from centers of rotation of the two rollers, so that two of said wires can be pulled simultaneously to enable simultaneous application of printing thereto.

8. The wire printing apparatus of claim 2, wherein the holder comprises a chuck for gripping the substantially straightened wire from opposite sides, a brush being operable with the wire correcting device and being provided to brush gripping surfaces of the chuck by substantially passing the chuck during movements of the wire correcting device.

9. The wire printing apparatus of claim 2, wherein the holder comprises at least one pressing element for holding the substantially straightened wire by pressing the wire, the pressing element being formed with a through hole through which printing can be applied.

10. The wire printing apparatus of claim 2, wherein the printing device comprises a laser marker.

* * * * *